United States Patent [19]

Wagner

[11] 3,978,812

[45] Sept. 7, 1976

[54] SELF-PROPELLED CROSSING AND FLOATING BRIDGE IMPLEMENT ALSO USABLE AS A LAND VEHICLE

[75] Inventor: Gerhard Wagner, Mainz-Lerchenberg, Germany

[73] Assignee: Magirus-Deutz Aktiengesellschaft, Ulm, Germany

[22] Filed: Nov. 14, 1975

[21] Appl. No.: 632,068

[30] Foreign Application Priority Data

Nov. 14, 1974 Germany ..... 2453925

[52] U.S. Cl. ..... 115/1 B

[51] Int. Cl.[2] ..... B60F 3/00

[58] Field of Search ..... 115/1 B, 1 R; 14/27

[56] References Cited

UNITED STATES PATENTS

| | | | |
|---|---|---|---|
| 3,661,114 | 5/1972 | Wagner et al. | 115/1 B |
| 3,682,126 | 8/1972 | Wagner et al. | 115/1 B |
| 3,908,580 | 9/1975 | Kinzel et al. | 115/1 B |

*Primary Examiner*—Trygve M. Blix
*Assistant Examiner*—Stuart M. Goldstein
*Attorney, Agent, or Firm*—Walter Becker

[57] ABSTRACT

A self-propelled crossing and floating bridge implement with a main floating body and a plurality of auxiliary floating bodies which when the vehicle is used as a land vehicle are arranged above the main floating body on the deck surface thereof. The auxiliary floating bodies are together pivotable toward one longitudinal side of the implement alongside the main floating body. When the vehicle is used as land vehicle, the auxiliary floating bodies are covered up by a buoyancy body which when the vehicle is to be used as crossing and floating implement is pivotable to a position alongside the other longitudinal side of the implement. In this last mentioned position of the main floating body the latter is covered by a roadway plate pivotally connected to the main floating body.

6 Claims, 5 Drawing Figures

SELF-PROPELLED CROSSING AND FLOATING BRIDGE IMPLEMENT ALSO USABLE AS A LAND VEHICLE

The present invention relates to a self-propelled crossing and floatable bridge implement with a main floating body and a plurality of auxiliary floating bodies which when driving over land are stored above the main floating body and more specifically the deck surface thereof and which together are pivotable toward one longitudinal side of said floating bridge implement adjacent the main floating body.

A floating bridge implement of this type has become known. This known implement, however, has the drawback that when unfolding the auxiliary floating body in the water, due to the different depths of immersion of said main floating body and said auxiliary floating body an undesired turning of the floating bridge implement can occur as a result of the current of the water. Furthermore, experience has shown that during the unilateral folding operation, the auxiliary floating body of the main floating bodies tilts in the water which is disadvantageous for the servicing, brings about a reduced buoyancy and impedes the folding operation for the auxiliary floating bodies.

It is, therefore an object of the present invention to so improve the crossing and floating bridge implement of the above mentioned general type that the floating bridge implement in unfolded position of the auxiliary floating bodies will for forming a bridge ramp or a shore ramp have in the water a substantially symmetrically incident flow cross section and that the additional floating bodies can be unfolded without any critical inclination of the main floating body in the water, while additionally making possible an optimum use of its length as bridge section by a high buoyancy volume of the floating bridge implement.

This object and other objects and advantages of the invention will appear more clearly from the following specification in connection with the following drawings, in which.

Figure 1:
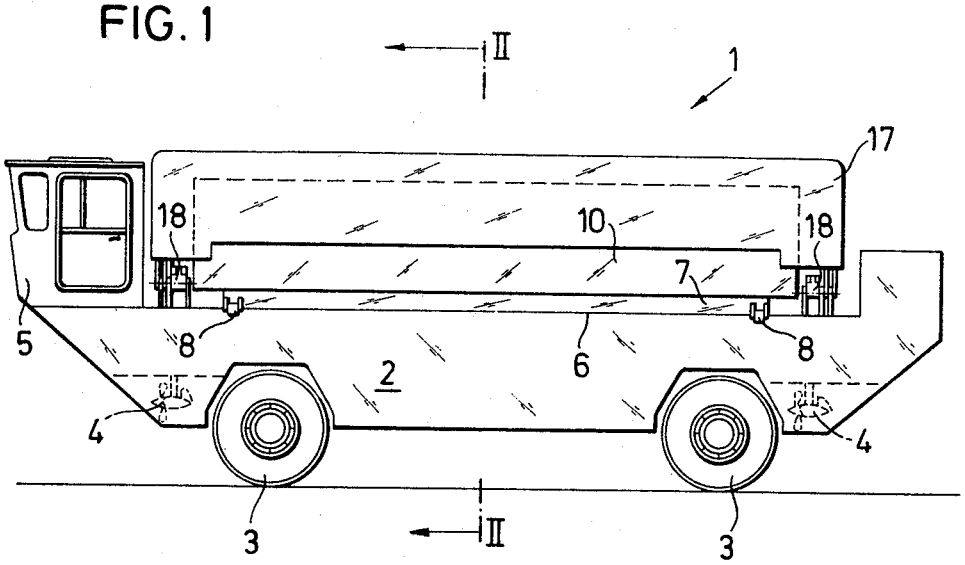
FIG. 1 is a side view of the crossing and floating bridge implement according to the invention.
Figure 2:
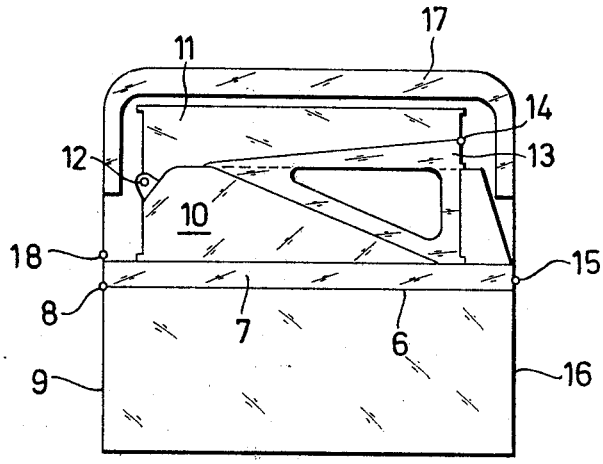
FIG. 2 is a section taken along the line II—II of FIG. 1.

The self-propelled crossing and floating bridge implement according to the present invention which is equipped with a main floating body and a plurality of auxiliary floating bodies which are pivotable together toward a longitudinal side of said implement is characterized primarily in that the auxiliary floating bodies are surrounded by a buoyancy body which in contrast to said auxiliary bodies is pivotal to the longitudinal side of the implement while following the unfolding operation, an opening of said buoyancy body within the region of the cover surface is adapted to be covered by a plate forming a part of the roadway. An optimum buoyancy volume of the floating bridge implement will be obtained by designing the buoyancy body as a bell-shaped bowl. The improved buoyancy volume will be aided by making the said bowl of said buoyancy body selectively of aluminum, synthetic material or a metal frame which is covered by a glass fiber reinforced skin of synthetic material.

When driving over land, a favorable placing of the roadway plate on the crossing and floating bridge implement will be realized by mounting the roadway plate between the main and auxiliary floating bodies with the width side of said roadway plate mounted on the deck surface of the main floating body.

In order to be able by simple means to move the roadway plate into the opening of the pivoted out buoyancy body, it is expedient that the roadway plate is on the main floating body, opposite to the auxiliary floating bodies, pivotable toward the other longitudinal side of the implement about a joint located in the plane of the deck surface.

Finally, it is suggested that the buoyancy body is pivotally connected to the main floating body through the intervention of joints which have a thickness corresponding to the distance of the roadway plate from the deck surface.

Referring now to the drawings in detail, the self-propelled crossing and floating bridge implement 1 according to the invention has a main floating body 2 forming the vehicle body, in which the units for driving the implement, such as the driving engine, transmission etc., are mounted. For driving over land, the main floating body 2 is equipped with wheels 3 which through the non-illustrated axles and springs are connected to the main floating body 2. For purposes of propelling the floating bridge implement 1 in the water, the front and rear ends of the main floating body 2 are equipped with ship propellers which are turnable about vertical axes. Connected to the main floating body 2 at one end thereof is a cabin 5 for the driver. This cabin contains all necessary operating elements for controlling and guiding the floating bridge implement. The main floating body 2 has at the top a cover surface 6 on which with its width side there is directly mounted a roadway plate 7. The roadway plate 7 is linked to the main floating body 2 and is pivotable about a joint 8 which is located in the plane of a longitudinal side 9 and at the level of the cover surface 6. When using the implement for driving over land, a plurality of auxiliary floating bodies 10, 11 in superimposed arrangement are mounted on the roadway plate 7 which is relatively thin-walled and which extends over the entire width of the main floating body 2. The auxiliary floating bodies 10,11 are through joints 12 pivotally connected to each other. Provided on the auxiliary floating bodies 11 arranged at the top, there are provided additional ramp elements 13 which are pivotable about joints 14. The auxiliary floating body 10 resting on the roadway plate 7 is through joints 15 pivotally connected to the floating body 2 while being pivotable about a longitudinal axis of the vehicle. The joints 15 are located at the level of the deck surface 6 and in the plane of the second longitudinal side 16. For purposes of forming a bridge or ferry, the auxiliary floating bodies 10, 11 and 13 can be folded about the joints 15 toward one side adjacent the main floating body 2.

In the position for overland drive of the implement according to the invention, both auxiliary floating bodies 10, 11 are surrounded by a hollow buoyancy body which in the manner of a bell is placed above the auxiliary floating bodies 10, 11. The hollow buoyancy body 17 is pivotally arranged on the main floating body 2 at the longitudinal side 9 through the intervention of joints 18 which are located around the extension of the longitudinal side 9 and spaced from the cover surface 6 by a distance which equals the thickness of the roadway plate 7.

Figure 3:
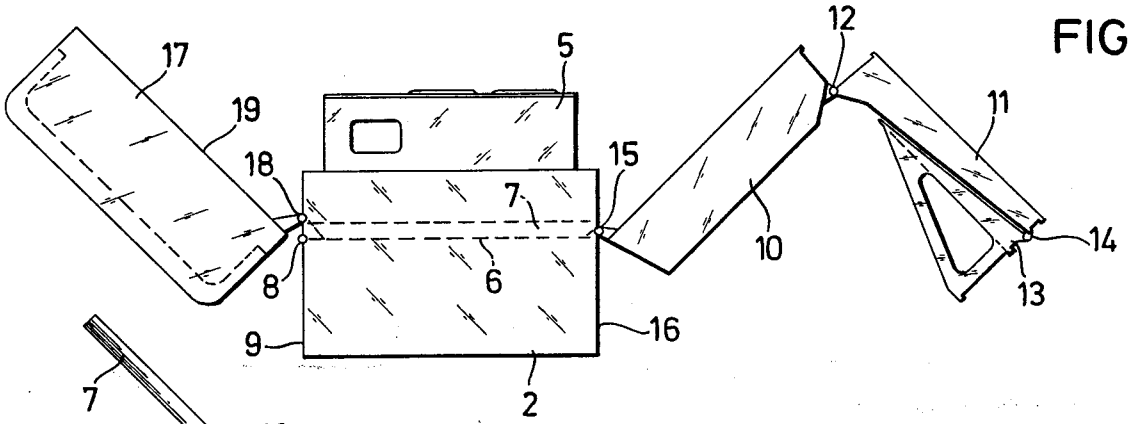
FIG. 3 illustrates by way of a diagrammatical front view the folding operation of the floating body of the bridge implement according to the invention.
Figure 4:
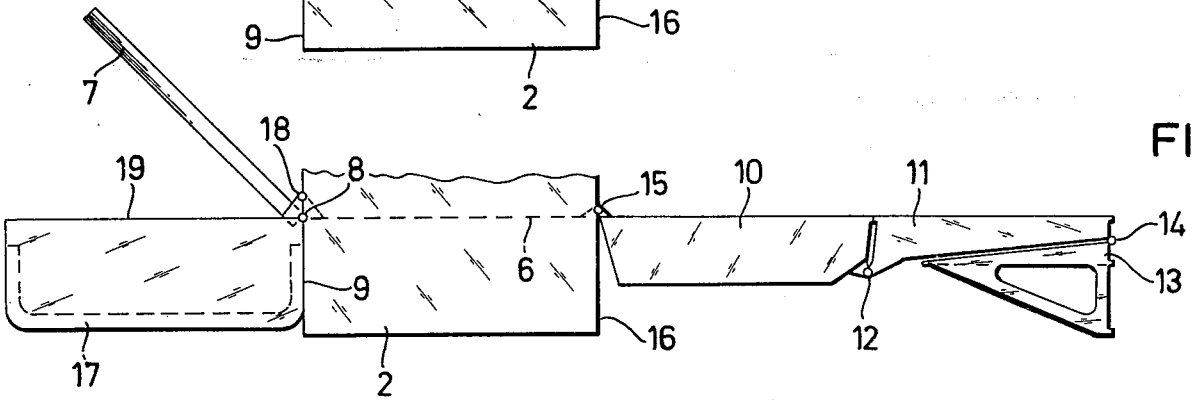
FIG. 4 shows the unfolded floating body of the floating bridge implement according to the invention, in its end position.
Figure 5:
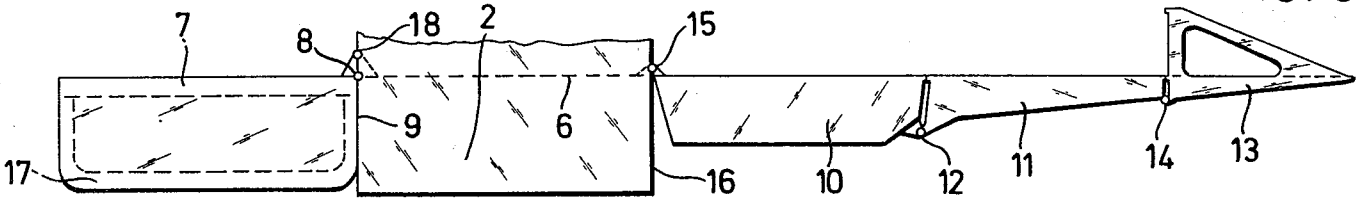
FIG. 5 illustrates the floating bodies of the floating bridge implement according to the invention unfolded to the shore or bank ramp.

As will be seen from FIG. 3, for building a bridge, first the buoyancy body 17 is pivoted about the joints 18 into a position adjacent the main floating body 2. Subsequently, the auxiliary floating bodies 10, 11 are folded about the joints 15 at the longitudinal side 16, likewise into a position adjacent the main floating body 2.

In order to assure that the hollow buoyancy body 17 can be used for building the bridge or ferry as roadway part, the roadway plate 7 arranged on the cover plate 6 is pivoted about the joints 8 onto the buoyancy body 17 into the opening 19. The hollow buoyancy body 17 can thus, similar to the main floating body 2 and the auxiliary floating bodies 10, 11 be used as roadway. The pivoting of the buoyancy body 17 and of the roadway plate about different joints 8, 18 has the advantage that for building a bridge or ferry, the top sides of the roadway plate 7 and the cover surface 6 are located in one plane.

As will be evident from the above, the design of the crossing and floating bridge implement according to the invention has the advantage that the additional buoyancy body including the roadway plate will during the folding operation of the auxiliary floating bodies act as counterweight counteracting the weight of the auxiliary floating bodies to be unfolded so that the main floating body will during the folding operation of the auxiliary floating bodies in the water hardly be inclined about its longitudinal axis.

A further advantage of the floating bridge implement according to the invention consists in that due to the additional buoyancy body with a simultaneous increase in the buoyancy volume, a longer roadway length is obtained.

Still another advantage of the floating bridge implement according to the invention consists in that due to the buoyancy body, the floating bridge implement unfolded to form a bridge will in the water have a substantially symmetrical incident cross section.

It is, of course, to be understood that the present invention is, by no means, limited to the specific showing in the drawings, but also comprises any modifications within the scope of the appended claims.

What I claim is:

1. A self-propelled crossing and floating bridge implement also usable as land vehicle, which includes: a main floating body with a deck surface, auxiliary floating means pivotally connected to said main floating body so as to be pivotable into a first position above said main floating body when said implement is used as land vehicle, said auxiliary floating means also being pivotable from said first position to a second position alongside one longitudinal side of said main floating body, a buoyancy body pivotally connected to said main floating body and pivotable to a position alongside the other longitudinal side of said main floating body, and a roadway plate linked to said main floating body and resting thereon when said implement is not used as bridge element, said roadway plate also being shiftable onto said buoyancy body when the latter occupies its position alongside said other longitudinal side of said main floating body, said buoyancy body also being shiftable from its position alongside said other longitudinal side of said main floating body into the position above said main floating body to cover up said auxiliary floating means when the latter occupy their first position above said main floating body.

2. An implement according to claim 1, in which the buoyancy body is hood-shaped.

3. An implement according to claim 1, in which when said implement is used as a land vehicle, said roadway plate rests on said main floating body between the latter and said auxiliary floating means.

4. An implement according to claim 1, which includes joint means arranged in the plane of said deck surface on said other longitudinal side of said main floating body and in which said roadway plate is pivotable from its position above said main floating body in a direction opposite to the direction in which said auxiliary floating means is pivotable from its first position to its second position.

5. An implement according to claim 4, which includes additional joint means arranged on the same side of said main floating body as said joint means for said roadway plate, said additional joint means being located above the joint means for said roadway plate and spaced from said last mentioned joint means by a distance substantially corresponding to the thickness of said roadway plate, said buoyancy body being pivotable about said additional joint means.

6. A self-propelled crossing and floating bridge implement, which includes a main floating body having a deck surface and lateral surfaces, a roadway plate linked to one longitudinal side of said main floating body and pivotable about a first axis parallel to said one longitudinal side of said main floating body and said deck surface thereof into a first position onto said deck surface of said main floating body, a buoyancy body with side surface is likewise linked to said one longitudinal side of said main floating body and is pivotable about a second axis parallel to and higher than said first axis from a first position above said roadway plate when the latter is in its first position on said deck surface to a second position in which one of the side surfaces of the buoyancy body engages the respective adjacent lateral surface of said main floating body and vice versa, said roadway plate being pivotable from said first position thereof to a second position onto said buoyancy body and vice versa, and a plurality of auxiliary floating bodies linked to each other while one of them is linked to the other one longitudinal side of said main floating body, said auxiliary floating bodies being pivotable from a first position upon said roadway plate when the latter is in its first position on said deck surface of said main floating body to a second position on said other side of said main floating body and vice versa.

* * * * *